US008308082B2

(12) United States Patent
Ivy

(10) Patent No.: US 8,308,082 B2
(45) Date of Patent: Nov. 13, 2012

(54) FIRE FIGHTING NOZZLE FOR PROJECTING FOG CLOUD

(76) Inventor: Eugene W. Ivy, Portland, OR (US)

( * ) Notice: Subject to any disclaimer, the term of this patent is extended or adjusted under 35 U.S.C. 154(b) by 193 days.

(21) Appl. No.: 11/692,067

(22) Filed: Mar. 27, 2007

(65) Prior Publication Data

US 2007/0181712 A1 Aug. 9, 2007

Related U.S. Application Data

(62) Division of application No. 10/919,862, filed on Aug. 17, 2004, now abandoned.

(51) Int. Cl.
*B05B 3/06* (2006.01)

(52) U.S. Cl. ..... 239/261; 239/251; 239/264; 239/280; 169/25; 169/52

(58) Field of Classification Search ..... 239/171, 239/172, 273–281, 319, 331–334, 380–389, 239/251–262, 264, 265; 169/30, 33, 70, 169/51, 52, 25
See application file for complete search history.

(56) References Cited

U.S. PATENT DOCUMENTS

| | | | | | |
|---|---|---|---|---|---|
| 540,218 | A | * | 5/1895 | Stanton | 239/251 |
| 674,343 | A | | 5/1901 | Oakes | |
| 843,585 | A | * | 2/1907 | Cole | 401/281 |
| 1,761,119 | A | | 6/1930 | Gouldbourn | |
| 1,953,837 | A | * | 4/1934 | Thorold et al. | 239/246 |
| 1,959,886 | A | * | 5/1934 | Wadsworth | 239/280.5 |
| 2,246,797 | A | | 6/1941 | Geddes | |
| 2,413,083 | A | | 12/1946 | Snowden et al. | |
| 2,526,265 | A | * | 10/1950 | Nulph | 239/226 |
| 2,756,829 | A | | 7/1956 | Phillips | |
| 2,813,753 | A | | 11/1957 | Roberts | |
| 2,884,075 | A | * | 4/1959 | Poon | 169/48 |
| 2,896,861 | A | | 7/1959 | Hruby | |
| 2,979,272 | A | | 4/1961 | Thorrez | |
| 2,990,885 | A | | 7/1961 | Brazier | |
| 3,082,960 | A | | 3/1963 | Swan | |
| 3,125,297 | A | * | 3/1964 | Copeland et al. | 239/261 |
| 3,424,250 | A | | 1/1969 | Thomae | |
| 3,661,211 | A | | 5/1972 | Powers | |
| 3,713,587 | A | | 1/1973 | Carson | |
| 3,731,878 | A | * | 5/1973 | Lubetzky et al. | 239/166 |
| 4,291,835 | A | | 9/1981 | Kaufman | |
| 4,582,255 | A | | 4/1986 | Won | |
| 4,674,686 | A | * | 6/1987 | Trapp | 239/279 |
| 4,697,740 | A | * | 10/1987 | Ivy | 239/271 |
| 4,789,099 | A | * | 12/1988 | Hager | 239/10 |
| 4,802,535 | A | | 2/1989 | Bakke | |
| 5,104,044 | A | * | 4/1992 | Ratell, Jr. | 239/240 |
| 5,211,337 | A | * | 5/1993 | Lukez | 239/251 |

(Continued)

*Primary Examiner* — Christopher Kim
(74) *Attorney, Agent, or Firm* — Dennis T. Griggs; Scott T. Griggs; Griggs Bergen LLP

(57) ABSTRACT

A fog or mist generating nozzle assembly produces a swirling fog pattern having a forward thrust component that permits an operator, stationed safely at a remote location relative to a fire source, to exercise directional control and positioning of a relatively large mist cloud on or about the fire source. The discharge nozzle includes a cylindrical bearing member and a cylindrical rotor member with multiple water discharge orifices that extend at a forward projection angle α relative to the nozzle axis. A pair of fog producing nozzles are configured with counter-rotating rotors, producing counter-rotating clouds that merge along a common vortex. This generates a composite mist cloud having a magnified forward thrust component, enabling remote directional control of the mist cloud.

9 Claims, 7 Drawing Sheets

U.S. PATENT DOCUMENTS

| | | | | | |
|---|---|---|---|---|---|
| D339,846 | S | | 9/1993 | Magee | |
| 5,253,716 | A | | 10/1993 | Mitchell | |
| 5,316,218 | A | * | 5/1994 | Bowen | 239/246 |
| 5,351,891 | A | | 10/1994 | Hansen et al. | |
| 5,409,067 | A | | 4/1995 | Esposito et al. | |
| 5,540,284 | A | | 7/1996 | Esposito et al. | |
| 5,655,608 | A | | 8/1997 | Sundholm | |
| 5,699,862 | A | | 12/1997 | Rey | |
| 5,833,005 | A | | 11/1998 | Woolcock | |
| 5,918,813 | A | | 7/1999 | Rucker | |
| 6,098,642 | A | * | 8/2000 | Crane | 134/167 C |
| 6,158,521 | A | | 12/2000 | Klump | |
| 6,398,136 | B1 | | 6/2002 | Smith | |
| 6,578,796 | B2 | | 6/2003 | Maeda | |
| 2002/0139543 | A1 | | 10/2002 | Baughman | |
| 2003/0089507 | A1 | | 5/2003 | Carrier et al. | |

* cited by examiner

FIRE FIGHTING NOZZLE FOR PROJECTING FOG CLOUD

CROSS REFERENCE TO RELATED APPLICATION

This is a divisional application of application Ser. No. 10/919,862, filed Aug. 17, 2004.

BACKGROUND OF THE INVENTION

1. Field of the Invention

The present invention relates generally to fluid discharge nozzles, and in particular to a fire fighting tool for producing a swirling (rotating) fog pattern that has a forward thrust component.

2. Description of the Related Art

Spray discharge nozzles have many applications, and fire fighting is one of particular interest. It is well known that water absorbs not only heat but also many of the toxic gases of a fire and tends to clear away the smoke and does so most effectively when broken up into a fine spray or mist. Spray generating nozzles distribute the water discharge over a larger volume than do conventional fluid discharge nozzles in which water is discharged in a converging pattern of diffused solid streams. Spray generating nozzles are particularly useful in combating interior fires and are often used to provide protection for firefighting personnel by creating a water spray shield around the firefighters.

Conventional spray generating nozzles typically include a housing, a passageway for conducting water from a water supply source such as a fire hose from the inlet to the discharge end of the nozzle and a device for particulating the water to break it up into a fine stream. Multiple openings intersect the discharge end of the nozzle for directly diffusing the discharge spray outwardly from the nozzle. A commonly used device for particulating water is an internal impeller, which turns in response to the flow of water across obliquely inclined impeller surfaces inside the housing.

One limitation of conventional spray generating nozzles is that a high pressure source of water must be available to provide sufficient projection for the discharge spray. Because the discharge nozzle outlet is substantially smaller than the supply hose in order to produce a diffused spray, a back pressure builds up within the nozzle housing, thereby limiting the discharge flow rate. The use of an internal impeller to particulate the water also requires mechanical bearings and the like, which increases the cost and mechanical complexity of the nozzle.

U.S. Pat. No. 5,351,891 to Hansen and others show a fixed, non-rotatable spray head in which discharge orifices project a focused, converging jet spray discharge pattern.

The nozzle disclosed in U.S. Pat. No. 4,697,740 to Ivy is a substantial improvement over conventional spray nozzles by virtue of its ability to generate a large cloud of fog or fine mist that is particularly effective for smothering a blaze. This is made possible by a rotary nozzle in which the discharge orifices project water droplets radially outwardly thereby producing a static fog pattern. Because the cloud remains static or centered relative to the nozzle, it is necessary for fire fighting personnel to position the rotary nozzle in close proximity to the blaze in order for it to have effective coverage. Moreover, by placing the nozzle close to the fire source, the mist cloud becomes caught in the updraft and is pulled away from the fire. Because the static cloud is not controllable in direction, it is necessary for the nozzle to be attended by an observer so that it can be repositioned from time to time to maintain the protective thermal shield around the fire source.

A limitation of conventional fog-cloud or mist-cloud generator nozzles is that the movement of the fog cloud or mist pattern is not controllable in any particular direction, and tends to remain centered on the nozzle or to drift randomly. It is often necessary for fire fighter personnel to approach dangerously close to a very hot fire in order to establish a mist cloud and hold it centered on the fire, to establish a thermal shield that allows the fire fighting personnel to work safely, and to smother the fire until it is extinguished or brought under control. This exposes the fire fighters to risk of serious burn injury and smoke inhalation, particularly where chemical fuel source fires are involved.

For these reasons, there is a continuing interest in improving fire fighting equipment generally, and water spray projection equipment in particular, especially for use around intense blaze situations. Improvements are needed in water projection equipment that will extend the safe operational limits of standard protective clothing and respiration equipment, and allow fire fighting personnel to work safely and effectively in close proximity to a fire source.

BRIEF SUMMARY OF THE INVENTION

An improved fog-cloud or mist-cloud generator nozzle according to the present invention produces a fog pattern having a forward thrust component that permits an operator, stationed safely at a remote location relative to a fire source, to exercise directional control and positioning of a relatively large volume of fog or mist on or about a fire source. The discharge nozzle includes a cylindrical bearing member closed at one end and open at the opposite end; means for connecting the bearing member to a fluid source; and a cylindrical sleeve member disposed concentric with and surrounding at least a portion of the bearing member and cooperating with the bearing member to form an annular chamber there between. The bearing member has a fluid passageway between the open and closed ends and a plurality of slots for allowing fluid entering the passageway to flow outwardly through the slots.

The sleeve member has a plurality of orifices communicating between the annular chamber and the exterior of the sleeve member. According to an important feature of the invention, the orifices extend at an acute forward projection angle relative to the nozzle axis, thus imparting a forward directional movement component to the water droplets as they are discharged. Additionally, the discharge orifices extend transversely to the radii of the sleeve member for imparting rotational torque to the sleeve member, thus producing a swirling (rotating) fog pattern that has a forward thrust component. As the rotor sleeve rotates in response to reaction forces imparted by the outward flow of fluid through the orifices, the fluid is particulated into a finely divided fog or mist and discharged along a swirling trajectory with a forward component of directional movement. When the annular chamber is pressurized, the fluid in the chamber serves as a bearing to support the sleeve member as it rotates about the bearing member.

According to one preferred embodiment, a pair of the fog producing nozzles of the invention are configured with counter-rotating rotors. The nozzles are positioned at laterally separated projection stations and are aimed at the fire source. Each nozzle generates a swirling (rotating) fog pattern or cloud that has a forward thrust component, swirling in counter-rotation relation to the other nozzle. The counter-rotating clouds intersect and intermix along a common vortex, thus reinforcing each other along the vortex, and producing a common rotating fog cloud pattern having a magnified forward vector thrust component, enabling directional control of the mist cloud for remote positioning.

According to another embodiment, dual counter-rotating nozzles are attached to a self-contained, portable tank unit with an internal pump and onboard power unit. The portable tank unit is skid mounted and capable of stand-alone operation, or can be slung below a helicopter for remote aerial stand-off operation, or truck-mounted for transport and set-up where road access is available.

According to yet another embodiment of the invention, dual counter-rotating nozzles are attached to portable, freestanding tripod units, each equipped with counter-rotating nozzles for set-up at safe, remote locations. The outputs of the counter-rotating nozzles combine along a common vortex to project a protective fog curtain or cloud onto or about a fire source for fire suppression and thermal shielding purposes. This allows fire fighting personnel to quickly set up the tripod units to gain initial control with protection of a thermal shield, and then reposition the tripod units and move progressively closer as the fire is contained, and then work safely in close proximity to the fire source.

According to a hand-held embodiment of the invention, the nozzle assembly is equipped with a handle shaft and a blunt (dome-shaped) bumper cap for manual application of fog or mist in industrial fire situations where penetration of plant infrastructure is to be avoided, for example around pressurized piping and tank containers holding caustic chemicals. In this embodiment, the nozzle is incorporated into a hand-held firefighting tool. The nozzle is mounted on a tubular shaft member having an open end; hose connection means for connecting the shaft member to a supply hose so that pressurized fluid is supplied to the nozzle; and the bumper cap is attached to the closed end of the bearing member. The bumper cap protects the rotor and prevents penetration damage to tubing and other plant equipment.

DETAILED DESCRIPTION OF THE PREFERRED EMBODIMENTS

In the description which follows, like parts are marked throughout the specification and drawings, respectively. The drawings are not necessarily to scale and in some instances, proportions have been exaggerated in order to move clearly depict certain features of the invention.

Figure 1:
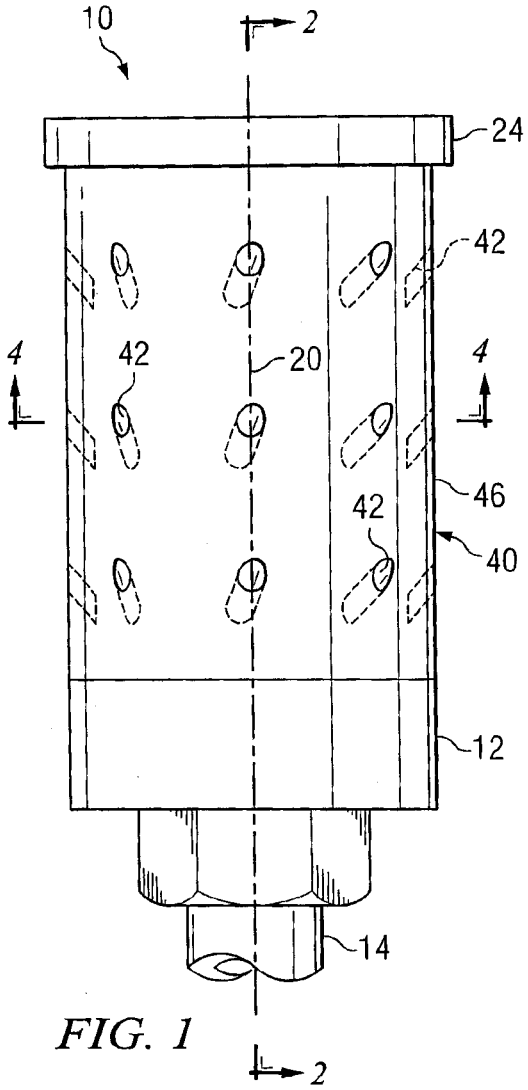
FIG. 1 is an elevational view of a fog generating nozzle constructed according to the present invention.
Figure 2:
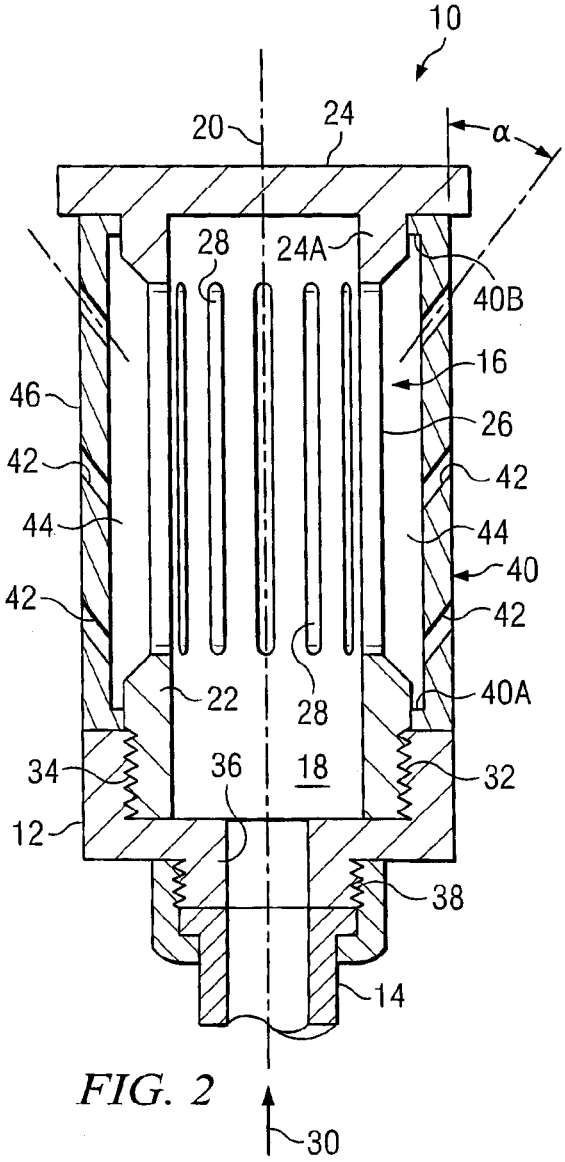
FIG. 2 is a sectional view of the nozzle of FIG. 1, taken along the line 2-2.

Referring to FIGS. 1 and 2, a fog generating nozzle 10 according to present invention is threadedly connected to a coupling member 12, which in turn is threadedly connected to a fluid conduit 14, such as a water pipe or hose. Water conduit 14 is adapted for connection to a supply main (not shown) for pressurizing the nozzle 10.

Figure 5:
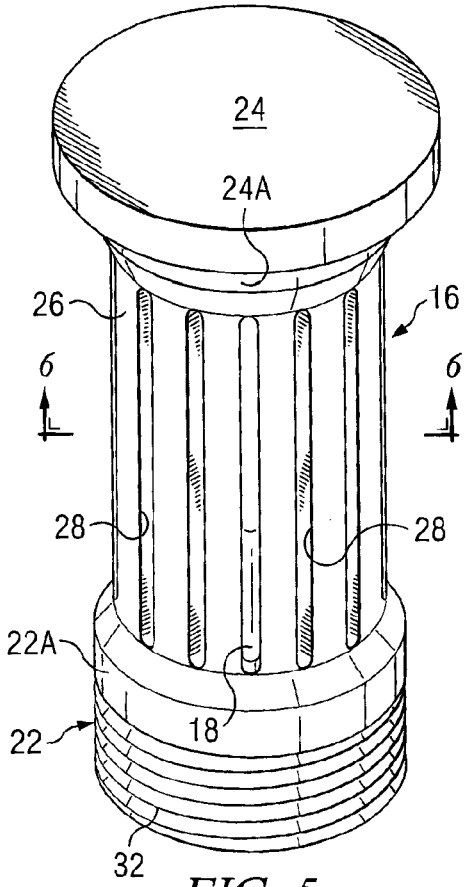
FIG. 5 is a perspective view of a bearing member component of the fog generating nozzle shown in FIG. 1.
Figure 6:
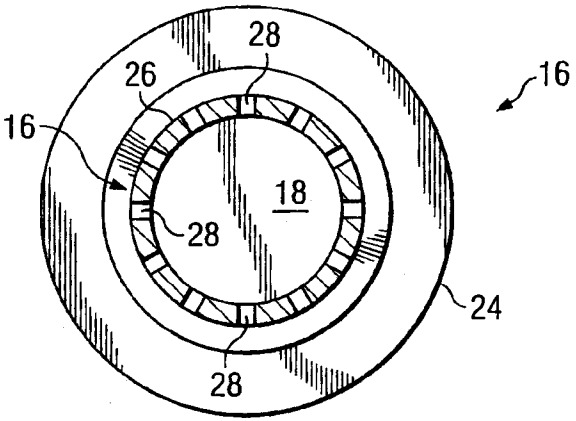
FIG. 6 is a sectional view of the bearing member component, taken along the line 6-6 of FIG. 5.

As can be seen in FIGS. 2, 5 and 6, the nozzle 10 includes a cylindrical bearing member 16, having a fluid passageway 18 extending along a longitudinal axis 20 from a threaded base member 22 to a closed top member 24. A reduced diameter sidewall portion 26 of bearing member 16 has a plurality of axially extending distribution openings in the form of elongated slots 28 disposed at angularly spaced intervals thereon. The combined discharge area of the slots 28 exceeds the cross sectional area of the supply conduit 14, thereby admitting pressurized water 30 into passage 18, virtually without imposing back pressure.

The base portion 22 is threaded at 32 and functions as a male member for mating with corresponding threads 34 on a female end of coupling 12, as best seen in FIG. 2, to connect bearing member 16 to the supply conduit 14. The corresponding male end 36 of coupling 12 is threadedly connected at 38 to the corresponding female end of fluid conduit 14, as also shown in FIG. 2. The threaded base member 22 is open to admit water flow and is provided with a cylindrical shoulder extension 22A which connects the threaded base portion to the reduced diameter sidewall portion. Likewise, closed top member 24 is provided with a cylindrical shoulder extension 24A, connecting it to the reduced diameter sidewall portion.

Figure 3:
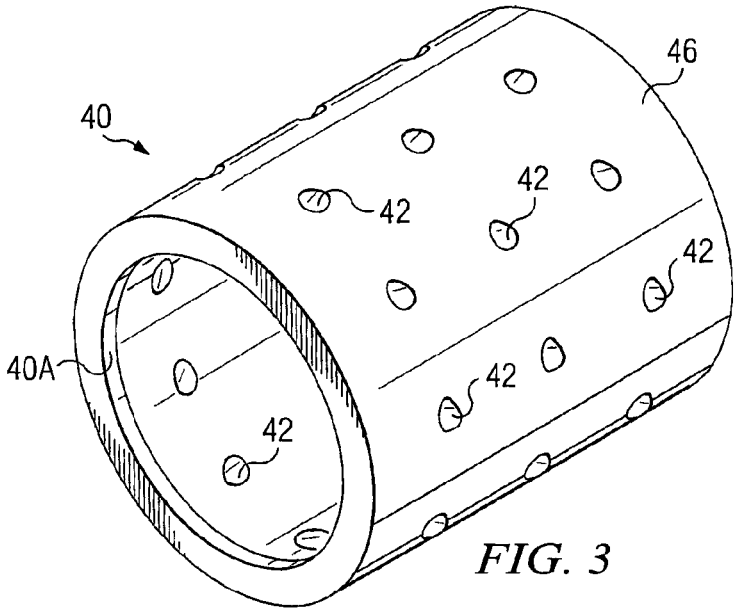
FIG. 3 is a perspective view of a rotor sleeve component of the fog generating nozzle shown in FIG. 1.
Figure 4:
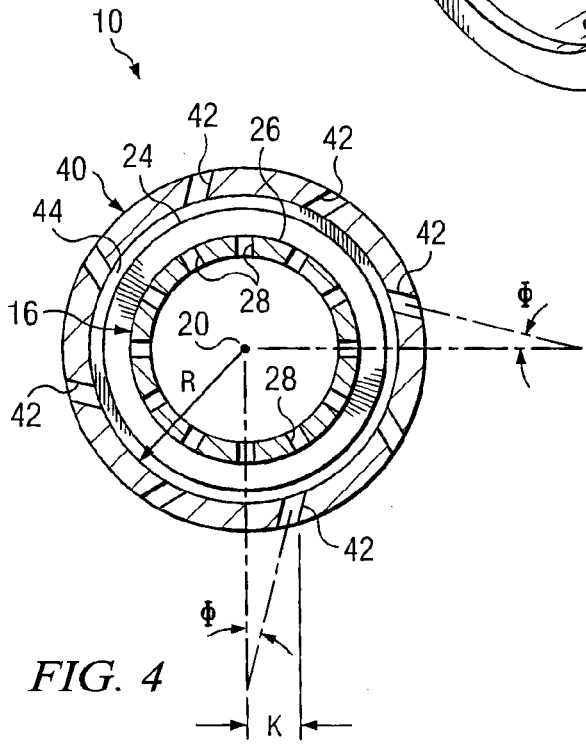
FIG. 4 is a sectional view of the rotor sleeve component, taken along the line 4-4 of FIG. 1.

Referring to FIGS. 2, 3 and 4, a rotor sleeve 40 is coupled for rotation on the bearing member 16 to form the nozzle 10. The rotor sleeve 40 is a hollow, cylindrical member intersected by a plurality of orifices 42 which preferably are equally spaced along respective parallel lines of circumference around the rotor sleeve 40. According to an important feature of the invention, the discharge orifices 42 intersect through the rotor sidewall 46 transversely at an acute pitch angle $\alpha$ with respect to the rotary axis 20, thus giving the mist particles a forward component of directional movement as they are discharged.

The pitch angle $\alpha$ is preferably in the range of from about 30-45 degrees, and more preferably in the range of about 35-42 degrees, as shown in FIG. 2. This is in contrast with the arrangement shown in my U.S. Pat. No. 4,697,740 in which the apertures 42 project at a right angle relative to the rotational axis 20. That arrangement produces a static cloud centered about the nozzle rotary axis and does not develop a forward directional cloud movement component in line with the rotary axis.

The orifices 42 also extend transversely at an acute angle Φ with respect to corresponding lines of radius R of rotor sleeve 40 so that a turning force is imparted to sleeve 40 when water is discharged through orifices 42. The angle Φ is preferably equal to about 30 degrees as measured from the orifice axis A to the principal radius line R, as shown in FIG. 4. This measurement is taken with the orifice 42 offset from the radius R by an offset spacing K (K=¼ inch for R=1 inch).

The rotor sleeve 40 is positioned concentric with bearing member 16 and is rotatable with respect to bearing member 16. As best shown in FIG. 2, rotor sleeve 40 surrounds central portion 26 and slots 28 in their entirety and partially overlaps base member 22 and top member 24. Rotor sleeve 40 includes radial flange portions 40A, 40B which maintain sleeve 40 in generally concentric alignment with bearing member 16. Flange portions 40A, 40B are dimensioned to permit a slight amount of radial as well as axial end play.

An annular chamber 44 is defined between bearing member 16 and rotor sleeve 40. When water 30 flows into passageway 18 under pressure, annular chamber 44 is pressurized with water to provide a water cushion upon which rotor sleeve 40 rides during rotation. Water flowing into passageway 18 will flow through slots 28 into annular chamber 44 and outwardly through orifices 42, thereby causing rotor sleeve 40 to rotate around bearing member 16.

The discharge of water 30 through the orifices 42 creates a reaction force having a component which is tangential to the curved surface 46 of the rotor sleeve 40, as well as a component which is normal thereto. The tangential component imparts rotational motion to sleeve 40 in much the same manner that a jet engine turbine is turned by the reaction force produced by the flow of combustion gases through the engine nozzles. The centrifugal force associated with the rotation of rotor sleeve 40 breaks up the water particles into a fine mist or fog. The water particles travel outwardly in a substantially spiral pattern. Thus, the water particles are carried a sufficient distance to enable the nozzle 10 to be effectively used for firefighting purposes.

The nozzle 10 discharges a greater volume of water than conventional nozzles (1260 gallons per minute as compared to 65 gallons per minute for conventional convergent nozzles) and distributes the fog or mist discharge over a larger area. The improved G.P.M. delivery is obtained because of the unusually low back pressure presented by operation of the cylindrical bearing and rotatable sleeve, and due to the absence of frictional loading associated with conventional mechanical roller bearing structures.

Figure 7:
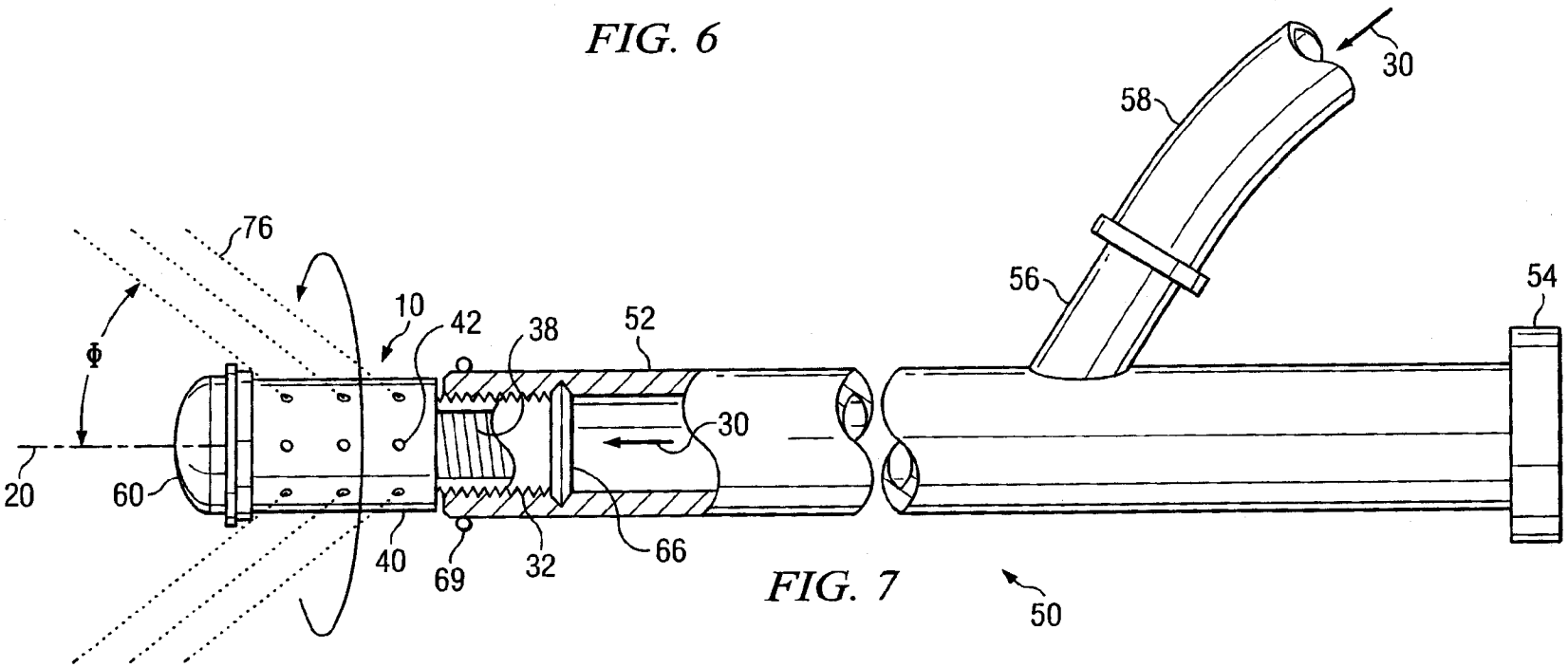
FIG. 7 is a side elevational view, partially broken away, of a fire fighting tool constructed according to the present invention, having a bumper cap and fog generating nozzle disposed thereon.
Figure 8:
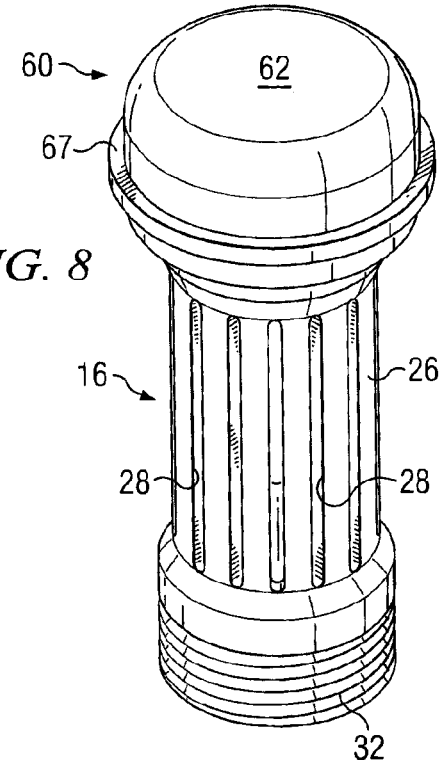
FIG. 8 is a perspective view of the bearing member component of the nozzle as removed from the fire fighting tool shown in FIG. 7.

According to another aspect of the invention, a hand-held firefighting tool 50 is depicted in FIGS. 7 and 8. The tool 50 includes a tubular shaft 52 having an end cap 54 sealing one end thereof and a fitting 56 extending outwardly from shaft 52 for coupling engagement with a fire hose 58 or the like. Mounted on the opposite end of shaft 52 are the nozzle 10 and a bumper cap 60, having a rounded face 62 to provide a relatively smooth surface on the forward end for opposing penetration when working around building structure such as machinery, flow conduits, tubing, tanks and the like. The bumper cap 60 is preferably machined from stainless steel stock. The means for connecting the tool 50 to the fluid supply hose 58 is a Y-branch connector fitting 56 integrally formed on the shaft member and having a longitudinal axis that extends transversely with respect to the longitudinal axis of the shaft member. The fluid discharge device, shaft member and connector fitting are also preferably formed of stainless steel stock material.

The forward end of shaft 52 is equipped with female threads 66 for engaging corresponding threads 32 on bearing member 16, to couple the nozzle 10 to the shaft 52. In one embodiment, the bumper cap 60 is integrally formed on the forward end of the bearing member 16. In an alternate embodiment, the bearing member 16 is equipped with male threads on or adjacent to the top portion 24 for engaging corresponding female threads on the bumper cap 60. In both embodiments, the nozzle 10 is disposed immediately behind the bumper cap 60 and flush with tubular shaft 52. According to this arrangement, the nozzle 10 is protected from damage resulting from inadvertent engagement of the nozzle against building structure and equipment.

Referring again to FIGS. 7 and 8, safety rings 67, 69 are formed on the external surface of the bumper cap 60 and the tubular shaft 52, respectively. The safety rings 67, 69 are annular weld beads located immediately forward and aft of the rotor sleeve 40. The safety ring 67 minimizes scraping engagement of the building structure against the rotor sleeve 40. The safety ring 69 serves the same purpose. According to this arrangement, the rotor sleeve 40 is protected against damaging impact force which might bend it and cause it to become unbalanced.

Figure 10:
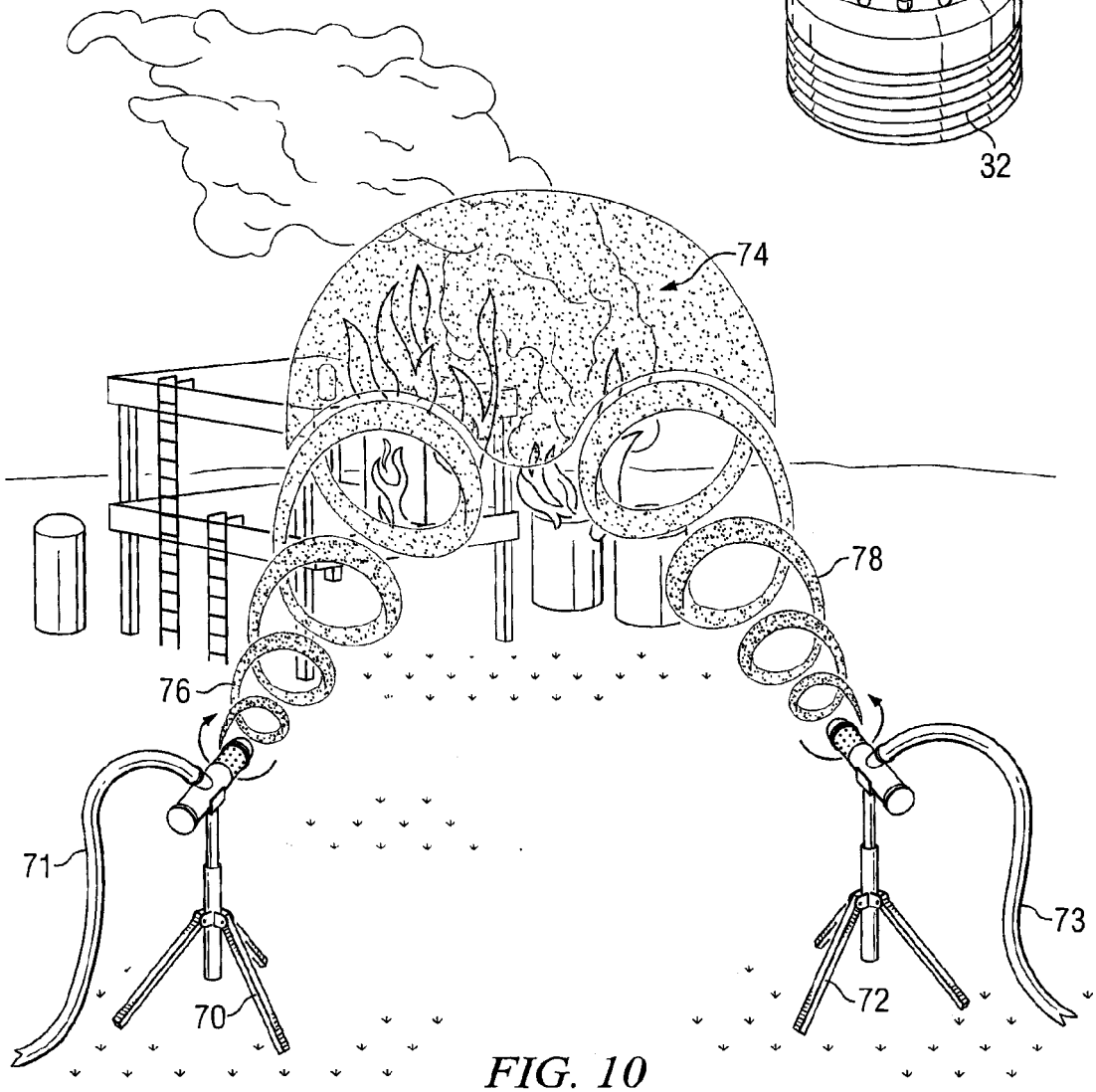
FIG. 10 is a perspective view of portable, freestanding tripod units, each equipped with counter-rotating nozzles set-up for generating mist clouds that merge, thereby producing a thermal mist curtain adjacent a chemical fire source.
Figure 9:
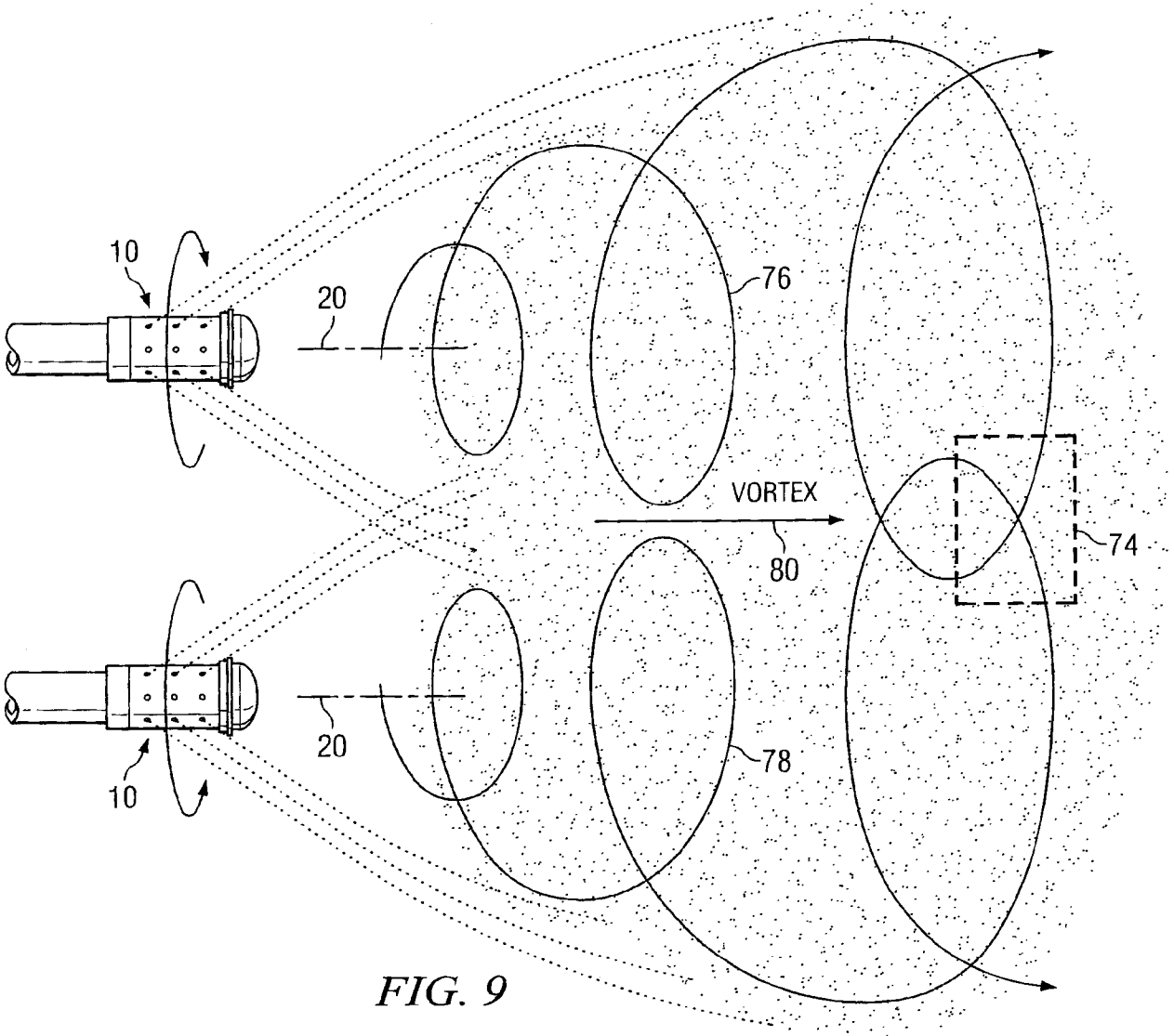
FIG. 9 is a plan view of a dual, counter-rotating nozzle installation for generating a swirling (rotating) fog pattern or cloud that has a forward thrust component, swirling in counter-rotation relation to the other nozzle.

Referring now to FIG. 9 and FIG. 10, free-standing tripod units 70, 72 are equipped with counter-rotating nozzles 10 and high pressure water conduits 71, 73 for set-up at safe, remote locations away from a fire source of intense heat, for example a burning portion of a petrochemical processing plant 74 s shown in FIG. 10. Swirling mist particles are discharged from the counter-rotating nozzles and are represented by the spiral lines 76, 78. These swirling mist clouds have a forward thrust component that projects the mist forward along the nozzle axis 20. The swirling mist particles move forward and merge along a common vortex 80 to project a protective fog curtain or cloud onto or about the fire source 74 for fire suppression and thermal shielding purposes. This allows fire fighting personnel to quickly set up the tripod units to gain initial control with protection of a thermal shield, and then repositing the tripod units.

The centrifugal force associated with the rotation of the sleeve member 40 particulates the water into finely divided mist particles and discharges the mist forwardly in a swirling, spiral pattern 76, 78. Extended coverage is obtained from available high pressure supply mains, and because of the substantially reduced back pressure, a large delivery rate approaching the supply conduit flow rate is obtained, thus enabling it to extinguish a fire and cool down the source prior to approach by firefighting personnel.

Because of the finely particulated nature of the discharged water droplets, heat from the fire source 74 will cause approximately 80% of the water droplets to flash to steam, thereby removing heat from the fire by increasing the temperature of the discharged water droplets to the flash point and by latent heat of vaporization which causes the water droplets to make the transition to the vapor state. For example, one cubic foot of water will produce approximately 1700 cubic feet of steam. The resulting steam forms a blanket around the fire source 74, which reduces the amount of oxygen available so as to "choke off" the fire. Moreover, the fog and steam propagate throughout the structure surrounding the fire source and into spaces that otherwise could not be reached. Even if the fire cannot be completely extinguished, the fire source will be cooled down sufficiently to allow firemen to work and move about in close proximity with additional hoses and fire fighting equipment to extinguish the fire.

One skilled in the art will recognize that the fog generating nozzle 10 of the present invention has many applications in addition to portable fire fighting equipment. For example, the nozzle 10 may be coupled to a rigid water pipe or flexible water hose and installed in a central location within a greenhouse or other enclosure in which humidity control is desired. The nozzle 10 can be pressurized periodically, as desired, to discharge a large volume of fog or mist which will propagate throughout the enclosure to maintain a desired humidity level. Moreover, a system of nozzles 10 can be installed in a building structure as an integral part of an automatic fire extinguishing system.

Preferred specifications for the nozzle 10:

nozzle net weight—24 lbs.

rotor material—carbon-filled Teflon angle of discharge apertures in rotor—35°-42°, bore size 3/16 in. diameter barrel of nozzle material—Schedule 40 stainless steel seamless pipe nozzle water connection—1.5 in. National (Fire Thpe) or 1.5 in. shutoff valve nozzle flow rating GPM at 175psi-1260 G.P.M.

The nozzle 10 constructed with the preferred dimensions given above offers more protection for firefighters and also provides a higher GPM flow. Specifically, the protection this improved design offers is a more dense fog pattern. This dense fog pattern provides a very high reduction in temperatures that firefighters are subjected to while approaching a burning structure or chemical fire.

In an industrial setting, i.e. chemical, petroleum and the like, there are piping, electrical, water, etc. systems running throughout the plant. A sharp, pointed tip is not always needed in a more open industrial plant environment which is often congested with vital supply lines that maintain the operation of the plant. In an industrial setting, most of the fires are related to the product that the plant produces, i.e. LPG, gasoline, diesel, jet fuel, etc. The improved nozzle 10 offers firefighters an option to any given fire situation. The blunt bumper cap poses no risk of penetration damage to surrounding infrastructure.

Figure 11:
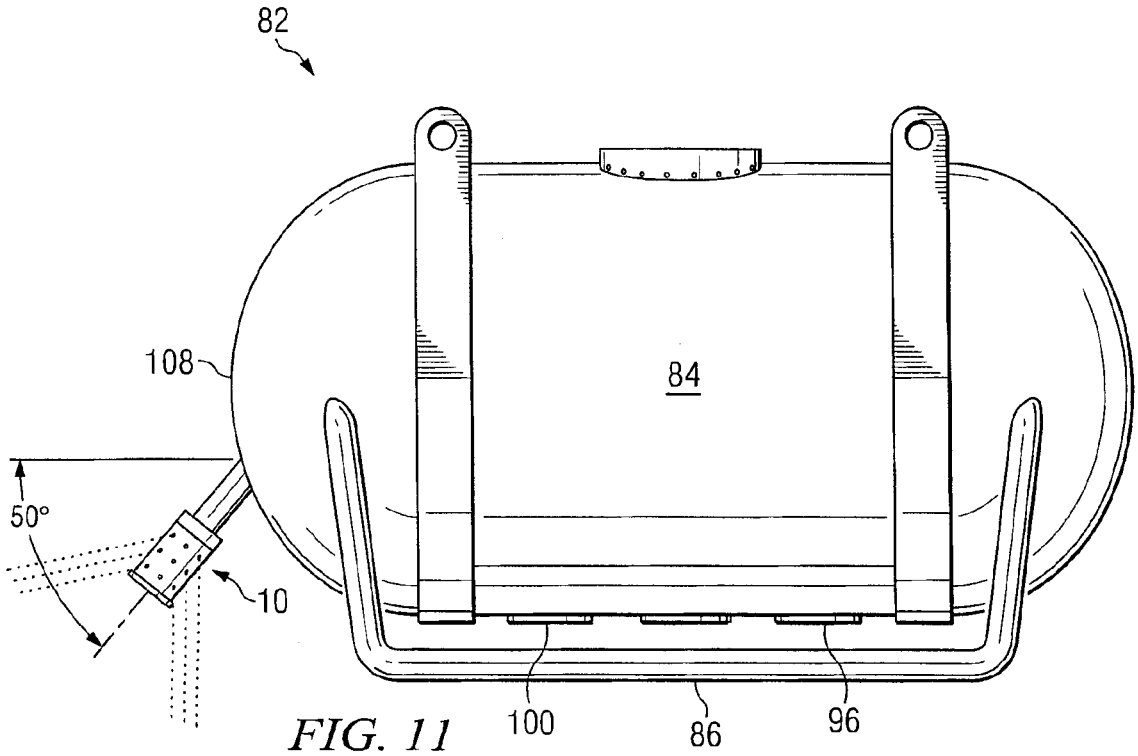
FIG. 11 is a side elevation view of a self-contained, portable tank unit with an internal pump, onboard power unit and dual counter-rotating nozzles.
Figure 12:
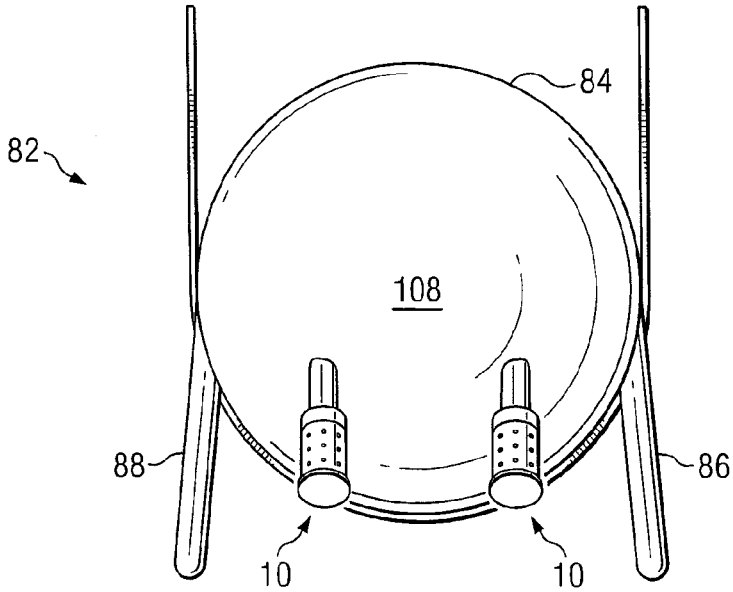
FIG. 12 is a front elevational view thereof.
Figure 13:
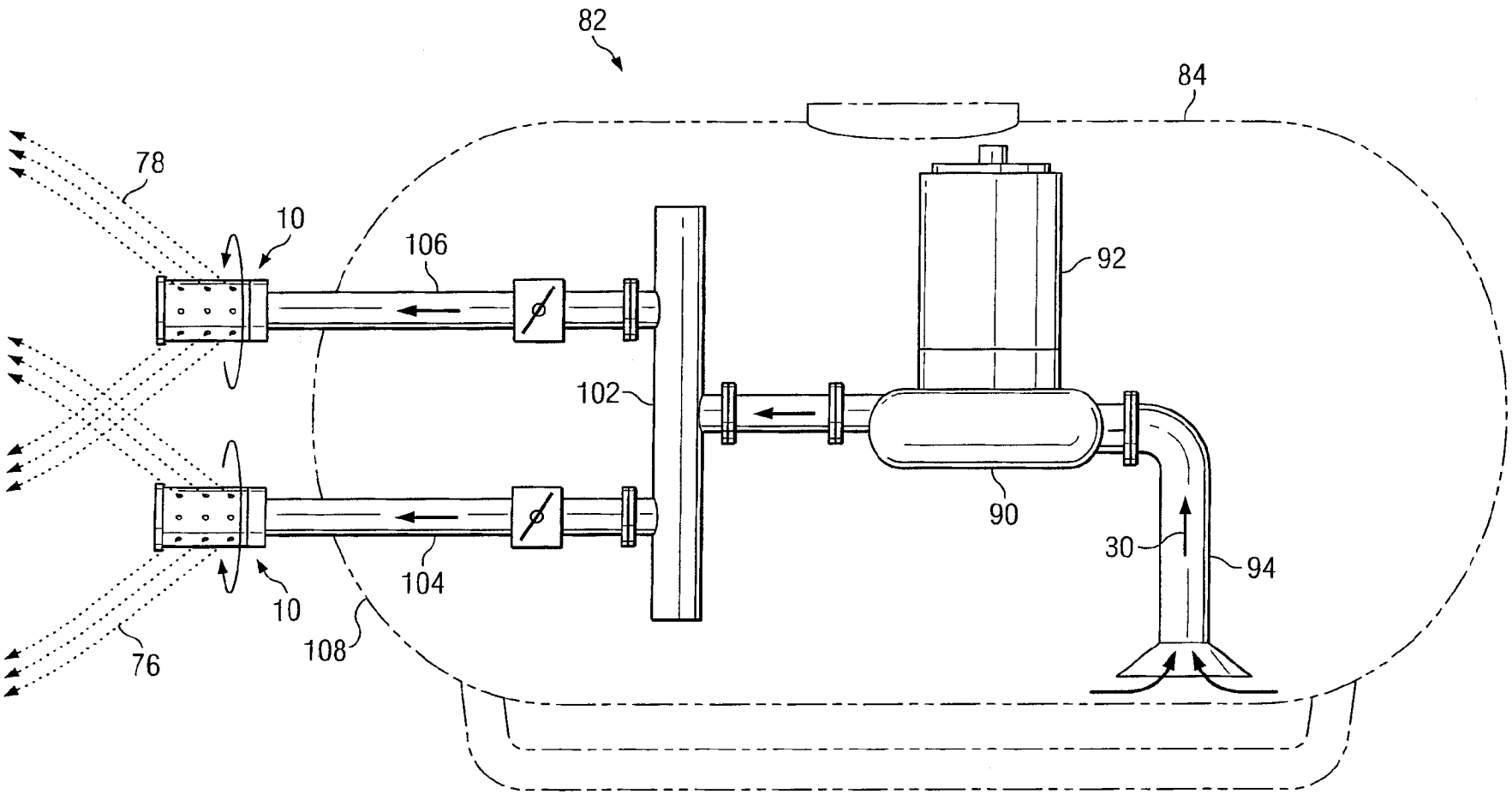
FIG. 13 is a simplified schematic view showing the interconnection of intake conduit, pump, drive motor, manifold and dual mist generating nozzles on the portable tank unit of FIG. 11.

Referring now to FIGS. 11, 12 and 13, a portable tank unit 82 makes use of the improved nozzle 10 for fighting wildfires. The portable tank unit 82 is skid mounted and capable of stand-alone operation, supplying high pressure water to tripod-mounted or hand-held nozzle operation, or can be slung below a helicopter for remote aerial stand-off operation, or truck-mounted for transport and set-up to supply a hand-held fire fighting nozzle or a tripod-mounted nozzle for operations where road access is available.

The tank unit 82 includes a 1500-gallon stainless steel tank 84 with dished ends, two skids 86, 88, a self-contained submersible pump 90, an electric drive motor 92, intake conduit 94, one-way fill valves 96, 98, 100 located on the bottom side of the tank, a distribution manifold 102, and internal interconnect piping. Discharge conduits 104, 106 extend from the manifold through one dished end 108 the tank at a 50° angle downward. There are two 3-inch diameter stainless steel conduits that form the working end of the tank system. Two mist generators 10 are mounted on the end of the discharge conduits. The rotor orifices of these nozzles are drilled at an angle that provides a forward thrust of the fog pattern, and counter-rotation rotor movement relative to each other.

With both mist generator patterns 76, 78 intersecting or converging on one another, rotating in opposite directions creates a thrust vortex 80 between the two nozzles, as shown in FIG. 9. This vortex adds a push to the fog cloud.

In a wildfire operation, the portable tank unit 82 is brought to the site of the wildfire via helicopter. The tank unit 82 is slung via a tether line below the helicopter loitering at a stand off position adjacent a burning forest canopy, and the fog cloud is projected from the dual nozzles onto the burning canopy. As the fog cloud contacts the burning canopy it is turned into steam almost instantly, thus cooling the ambient temperature and removing a significant amount of heat from the area. It also blankets the area with a thick fog that removes a significant amount of oxygen from the burning canopy. The tank system 82 provides a fog pattern approximately 120 feet wide, and when loaded with 1500 gallons of water covers a path of approximately one-quarter mile in length.

The electrical power supply for the tank unit's self-contained drive motor 92 is located in the helicopter and is operated by one of the crew. The tank unit can also be mounted on a truck or off-road vehicle that can be deployed ahead of the fire. The tank system creates a dense fog cover at lower elevations beneath the canopy. This dense fog cools the ambient temperature and at the same time soaks the forest floor vegetation, thus reducing the fuel element of the fire triangle.

Although the invention has been described with reference to certain exemplary arrangements, it is to be understood that the forms of the invention shown and described are to be treated as preferred embodiments. Various changes, substitutions and modifications can be realized without departing from the spirit and scope of the invention as defined by the appended claims.

I claim:

1. A fire fighting system for projecting water onto or about a fire source, the system comprising:

a first nozzle apparatus comprising a first sleeve and a first bearing member, each extending along a first longitudinal axis and being generally cylindrical shaped, the first bearing member having a first connection end, a first central portion, and a first distal end, the first bearing member having a first threaded coupling member at the first connection end with a first fluid passageway therein, wherein the first fluid passageway has a first fluid passageway cross-sectional area perpendicular to the first longitudinal axis, the first bearing member having a first internal central fluid cavity extending along the first longitudinal axis in the first central portion thereof, the first bearing member having a first plurality of elongated slots distributed about the first longitudinal axis, each formed through the first bearing member opening to the first internal central fluid cavity, and each extending parallel to the first longitudinal axis, wherein the first internal central fluid cavity from the first fluid passageway to the longitudinal extent of the first plurality of elongated slots at the first distal end has no cross-sectional area perpendicular to the first longitudinal axis that is less than the first fluid passageway cross-sectional area, and wherein a first combined discharge area of the first plurality of elongated slots is greater than the first fluid passageway cross-sectional area, the first bearing member having a first connection end shoulder extension providing a first connection end fluidic bearing surface, the first bearing member having a first distal end shoulder extension providing a first distal end fluidic bearing surface, the first sleeve being rotatably coupled to the first bearing member, such that a first annular chamber is formed between the first bearing member and the first sleeve, wherein the first annular chamber is fluidly coupled to the first fluid passageway via the first plurality of elongated slots and via the first internal central fluid cavity, the first sleeve having a first connection end flange shaped to at least partially mate with the first connection end fluidic bearing surface, wherein the first connection end fluidic bearing surface is fluidly connected to the first annular chamber, the first sleeve having a first distal end flange shaped to at least partially mate with the first distal end fluidic bearing surface, wherein the first distal end fluidic bearing surface is fluidly connected to the first annular chamber, the first sleeve having a first plurality of orifices distributed axially and circumferentially about the first sleeve, each of the first plurality of orifices extending through the first sleeve and opening to the first annular chamber, each of the first plurality of orifices extends along a respective first orifice axis, each first orifice axis being at a first acute pitch angle relative to the first longitudinal axis in a range of about 30-45 degrees so that during operation fluid exits the first plurality of orifices toward the first distal end, and each first orifice axis being at a positive acute radial angle with respect to corresponding radial lines extending in planes perpendicular to the first longitudinal axis so that during operation fluid exits the first plurality of orifices toward a first rotational direction;

a first stand coupled to and supporting the first nozzle apparatus;

a second nozzle apparatus comprising a second sleeve and a second bearing member, each extending along a second longitudinal axis and being generally cylindrical shaped, wherein the first longitudinal axis is not aligned with the second longitudinal axis, the second bearing member having a second connection end, a second central portion, and a second distal end, the second bearing member having a second threaded coupling member at the second connection end with a second fluid passageway therein, wherein the second fluid passageway has a second fluid passageway cross-sectional area perpendicular to the second longitudinal axis, the second bearing member having a second internal central fluid cavity extending along the second longitudinal axis in the second central portion thereof, the second bearing member having a second plurality of elongated slots distributed about the second longitudinal axis, each formed through the second bearing member opening to the second internal central fluid cavity, and each extending parallel to the second longitudinal axis, wherein the second internal central fluid cavity from the second fluid passageway to the longitudinal extent of the second plurality of elongated slots at the second distal end has no cross-sectional area perpendicular to the second longitudinal axis that is less than the second fluid passageway cross-sectional area, and wherein a second combined discharge area of the second plurality of elongated slots is greater than the second fluid passageway cross-sectional area, the second bearing member having a second connection end shoulder extension providing a second connection end fluidic bearing surface, the second bearing member having a second distal end shoulder extension providing a second distal end fluidic bearing surface, the second sleeve being rotatably coupled to the second bearing member, such that a second annular chamber is formed between the second bearing member and the second sleeve, wherein the second annular chamber is fluidly coupled to the second fluid passageway via the second plurality of elongated slots and via the second internal central fluid cavity, the second sleeve having a second connection end flange shaped to at least partially mate with the second connection end fluidic bearing surface, wherein the second connection end fluidic bearing surface is fluidly connected to the second annular chamber, the second sleeve having a second distal end flange shaped to at least partially mate with the second distal end fluidic bearing surface, wherein the second distal end fluidic bearing surface is fluidly connected to the second annular chamber, the second sleeve having a second plurality of orifices distributed axially and circumferentially about the second sleeve, each of the second plurality of orifices extending through the second sleeve and opening to the second annular chamber, each of the second plurality of orifices extends along a respective second orifice axis, each second orifice axis being at a second acute pitch angle relative to the second longitudinal axis in a range of about 30-45 degrees so that during operation fluid exits the second plurality of orifices toward the second distal end, and each second orifice axis being at a negative acute radial angle with respect to corresponding radial lines extending in planes perpendicular to the second longitudinal axis so that during operation fluid exits the second plurality of orifices toward a second rotational direction, wherein the first rotational direction is opposite the second rotational direction; and a second stand coupled to and supporting the second nozzle apparatus.

2. The fire fighting system as recited in claim 1, wherein the first connection end fluid bearing surface extends in radial and axial directions with respect to the first longitudinal axis, wherein the first distal end fluidic bearing surface extends in radial and axial directions with respect to the first longitudinal axis, wherein the second connection end fluid bearing surface extends in radial and axial directions with respect to the second longitudinal axis, and wherein the second distal end fluidic bearing surface extends in radial and axial directions with respect to the second longitudinal axis.

3. The fire fighting system as recited in claim 1, wherein the positive acute radial angle of the first plurality of orifices is about 30 degrees, and wherein the negative acute radial angle of the second plurality of orifices is about −30 degrees.

4. The fire fighting system as recited in claim 1, wherein the first acute pitch angle relative to the first longitudinal axis in a range of about 32-42 degrees, and wherein the second acute pitch angle relative to the second longitudinal axis in a range of about 32-42 degrees.

5. The fire fighting system as recited in claim 1, wherein the first nozzle apparatus is configured to discharge fluid at a first flow rate of at least 1000 gallons per minute, and wherein the second nozzle apparatus is configured to discharge fluid at a second flow rate of at least 1000 gallons per minute.

6. The fire fighting system as recited in claim 5, wherein each of the first plurality of orifices has a first bore diameter size of about 3/16 inch, wherein each of the second plurality of orifices has a second bore diameter size of about 3/16 inch, and wherein each of the first fluid passageway and the second fluid passageway has a diameter of about 1.5 inches.

7. The fire fighting system of claim 6, wherein the first threaded coupling member and the second threaded coupling member are each configured to mate with a 1.5 inch diameter hose with National Standard Threads.

8. The fire fighting system as recited in claim 1, wherein each of the first sleeve and the second sleeve comprises carbon-filled polytetrafluoroethylene material, and wherein each of the first bearing member and the second bearing member comprises stainless steel.

9. The fire fighting system of claim 1, wherein the first stand has a first tripod structure, and wherein the second stand has a second tripod structure.

* * * * *